US006384384B1

(12) United States Patent
Connolly et al.

(10) Patent No.: US 6,384,384 B1
(45) Date of Patent: May 7, 2002

(54) BOIL DRY DETECTION IN COOKING APPLIANCES

(75) Inventors: Allan J. Connolly, Albany; Aditya Kumar, Niskayona, both of NY (US)

(73) Assignee: General Electric Company, Schenectady, NY (US)

( * ) Notice: Subject to any disclaimer, the term of this patent is extended or adjusted under 35 U.S.C. 154(b) by 61 days.

(21) Appl. No.: 09/627,585

(22) Filed: Jul. 28, 2000

(51) Int. Cl.[7] ..... H05B 1/02; H05B 3/68

(52) U.S. Cl. ..... 219/481; 219/497; 219/506; 219/449; 219/452; 340/589; 374/107

(58) Field of Search ..... 219/481, 497, 219/501, 506, 494, 499, 449, 452; 374/102, 103, 107; 340/584, 589

(56) References Cited

U.S. PATENT DOCUMENTS

| | | | | |
|---|---|---|---|---|
| 4,740,664 A | | 4/1988 | Payne et al. | |
| 5,079,407 A | * | 1/1992 | Baker | 219/448 |
| 5,389,764 A | | 2/1995 | Nishii et al. | |
| 5,958,272 A | * | 9/1999 | Taplan et al. | 219/464 |
| 6,118,105 A | * | 9/2000 | Berkcan et al. | 219/497 |

OTHER PUBLICATIONS

U.S. application No. 09/356,965; filed Jul. 19, 1999, entitled "Monitoring and Control System for Monitoring the Boil State of Contents of a Cooking Utensil".

U.S. application No. 09/356,964; filed Jul. 19, 1999, entitled "Monitoring and Control System for Monitoring the Temperature of a Glass Ceramic Cooktop".

U.S. application No. 09/627,585; filed Jul. 28, 2000, entitled "Boil Dry Detection in Cooking Applicances".

* cited by examiner

*Primary Examiner*—Teresa Walberg
(74) *Attorney, Agent, or Firm*—Pierce Atwood

(57) ABSTRACT

Boil dry conditions are detected in utensils heated on a cooking appliance having at least one energy source disposed under a cooking surface such as a glass-ceramic plate and a controller for controlling the level of power supplied to the energy source. The boil dry detection system includes a temperature sensor for providing a signal representative of the glass-ceramic temperature to the controller. The controller controls the power source in response to the temperature signal so as to prevent the glass-ceramic plate from exceeding a maximum temperature and provides a power signal that is indicative of the level of power being supplied to the energy source. The controller generates an estimate of the first and second derivatives with respect to time of either the temperature signal or the power signal, depending on its operating mode. The controller then produces the cross-correlation of the first and second derivative estimates and provides a boil dry indication when the cross-correlation exceeds a predetermined threshold. In one preferred embodiment, the portion of the controller that generates the derivative estimates is implemented as two Kalman filters.

17 Claims, 3 Drawing Sheets

BOIL DRY DETECTION IN COOKING APPLIANCES

BACKGROUND OF THE INVENTION

This invention relates generally to detecting a boil dry condition in a utensil being heated on a cooking appliance and more particularly to boil dry detection in glass-ceramic cooking appliances.

The use of glass-ceramic plates as the cooking surface in cooking appliances such as cooktops and ranges is well known. Such cooking appliances (referred to herein as glass-ceramic cooktop appliances) typically include a number of heating elements or energy sources mounted under the glass-ceramic plate and an electronic controller. The glass-ceramic plate presents a pleasing appearance and is easily cleaned in that its smooth, continuous surface lacks seams or recesses in which debris can accumulate. The glass-ceramic plate also prevents spillovers from falling onto the energy sources below. When a user selects a power setting for one of the energy sources, the controller ordinarily will cause an appropriate level of power to be supplied to the energy source. This is referred to as the open-loop mode of operation.

In one known type of glass-ceramic cooktop appliance, the glass-ceramic plate is heated by radiation from one or more of the energy sources disposed beneath the plate. The glass-ceramic plate is sufficiently heated by the energy source to heat utensils placed on it primarily by conduction from the heated glass-ceramic plate to the utensil. Another type of glass-ceramic cooktop appliance uses an energy source that radiates substantially in the infrared region in combination with a glass-ceramic plate that is substantially transparent to such radiation. In these appliances, a utensil placed on the cooking surface is heated partially by radiation transmitted directly from the energy source to the utensil, rather than by conduction from the glass-ceramic plate. Such radiant glass-ceramic cooktop appliances are more thermally efficient than other glass-ceramic cooktop appliances and have the further advantage of responding more quickly to changes in the power level applied to the energy source. Yet another type of glass-ceramic cooktop appliance inductively heats utensils placed on the cooking surface. In this case, the energy source is an RF generator that emits RF energy when activated. The utensil, which comprises an appropriate material, absorbs the RF energy and is thus heated.

In each type of glass-ceramic cooktop appliances, provision must be made to avoid overheating the glass-ceramic plate. For most glass-ceramic materials, the operating temperature should not exceed 600–700° C. for any prolonged period. Under normal operating conditions, the temperature of the glass-ceramic plate will generally remain below this limit. However, conditions can occur during open-loop mode operation that can cause this temperature limit to be exceeded. Commonly occurring examples include operating the appliance with a small load or no load (i.e., no utensil) on the cooking surface, using badly warped utensils that make uneven contact with the cooking surface, and operating the appliance with a shiny and/or empty utensil.

To protect the glass-ceramic plate from extreme temperatures, a control system is utilized in which temperature sensors provide a signal indicative of the glass-ceramic temperature to the appliance's controller. If the glass-ceramic plate approaches its maximum temperature, the controller switches from the open-loop mode to a special control algorithm, known as the thermal limiter mode. In the thermal limiter mode, the controller overrides the user power settings and reduces power to the energy sources to maintain the temperature of the glass-ceramic cooking surface at a relatively constant, safe temperature.

Another concern with cooking appliances generally is a boil dry condition. A boil dry condition occurs when all the liquid contents of a heated utensil evaporate during the boil phase. This commonly happens when a utensil is inadvertently left on a hot cooking surface or otherwise overheated. A boil dry condition can cause burned food, utensil damage and potential fire hazards. Accordingly, automatic detection of a boil dry condition is a desirable feature in cooking appliances.

In glass-ceramic cooktop appliances, it is known to use the glass ceramic temperature to determine when a utensil has boiled dry. Specifically, when a utensil containing water or another liquid is placed on a glass-ceramic cooking surface and the burner is turned on, the glass-ceramic temperature initially increases rapidly. The glass-ceramic temperature will continue to rise until the utensil contents come to a boil. During the boil phase, the utensil contents will boil off at a steady temperature and remove excess heat via evaporation. With this steady heat removal, the glass-ceramic temperature also reaches a steady state value some time after the contents come to a boil. However, when the liquid completely boils off, there is a sudden drop in heat removal from the pan, and consequently, the glass-ceramic temperature increases rapidly. This temperature spike is thus indicative of the boil dry condition.

One known approach to detecting the sudden rise in temperature is to monitor the first derivative of the output of the glass-ceramic temperature sensor. However, this signal is quite noisy and evaluating the first derivative of the temperature signal with respect to time can produce a highly corrupted estimate. Furthermore, monitoring glass-ceramic temperature will not effectively detect boil dry events in the thermal limiter mode. This is because the controller maintains the glass-ceramic plate at a relatively constant temperature during thermal limiter operation. Therefore, the glass-ceramic temperature will not spike when a boil dry condition occurs.

Accordingly, it would be desirable to be able to accurately detect boil dry events under both the open-loop and thermal limiter modes.

BRIEF SUMMARY OF THE INVENTION

The above-mentioned need is met by the present invention, which provides a boil dry detection system for a cooking appliance having at least one energy source disposed under a cooking surface and a power source for providing power to the energy source. The boil dry detection system includes a means for providing a signal representative of a parameter associated with the cooking appliance and a means for generating an estimate of the first and second derivatives of the signal with respect to time. The system further includes a means for producing the cross-correlation of the first and second derivative estimates and a means for providing a boil dry indication when the cross-correlation exceeds a predetermined threshold.

The present invention and its advantages over the prior art will become apparent upon reading the following detailed description and the appended claims with reference to the accompanying drawings.

BRIEF DESCRIPTION OF THE DRAWINGS

The subject matter that is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
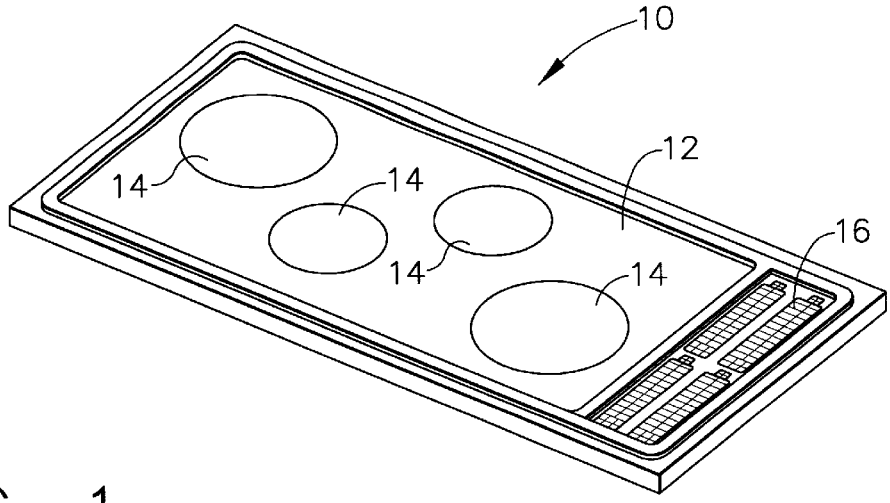
FIG. 1 is a perspective view of a glass-ceramic cooktop appliance incorporating a preferred embodiment of the present invention.

Referring to the drawings wherein identical reference numerals denote the same elements throughout the various views, FIG. 1 shows a glass-ceramic cooktop appliance 10 having a glass-ceramic plate 12 that provides a cooking surface. The appliance 10 can be any type of cooktop appliance including a range having an oven and a cooktop provided thereon or a built-in cooktop unit without an oven. Furthermore, the present invention is not limited to only glass-ceramic cooktop appliances and is applicable to almost any type of cooktop appliance. Circular patterns 14 formed on the cooking surface of the plate 12 identify the positions of each of a number (typically, but not necessarily, four) of burner assemblies (not shown in FIG. 1) located directly underneath the plate 12. A control panel 16 is also provided. As is known in the field, the control panel 16 includes knobs, touch pads or the like that allow an operator of the appliance 10 to individually control the temperature of the burner assemblies.

Figure 2:
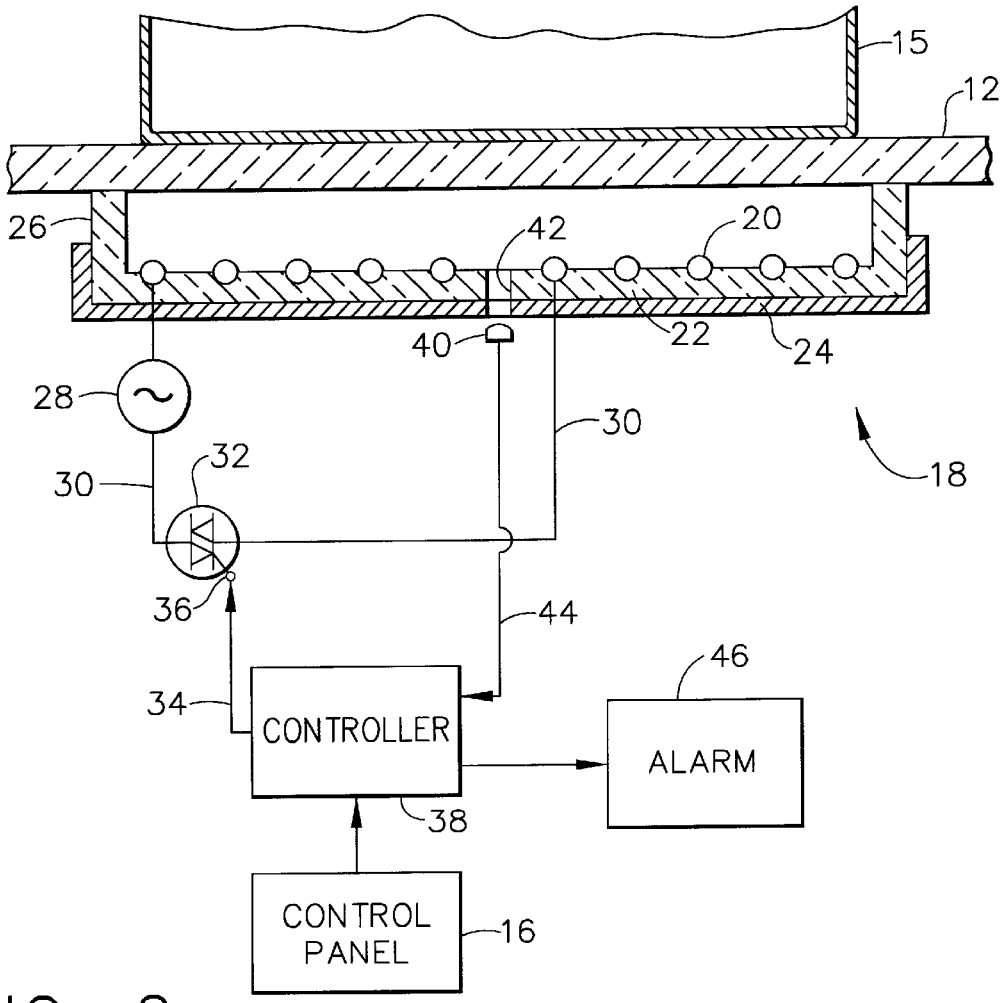
FIG. 2 is partly schematic view of a glass-ceramic cooktop appliance showing one of its burner assemblies in cross-section.

Turning to FIG. 2, an exemplary one of the burner assemblies, designated generally by reference numeral 18, is shown located beneath the glass-ceramic plate 12 so as to heat a utensil 15 placed on the plate 12. The burner assembly 18 includes a controllable energy source 20 in the form of an open coil electrical resistance element, which is designed when fully energized to radiate primarily in the infrared region of the electromagnetic energy spectrum. It should be noted that another type of energy source, such as an RF generator, could be used in place of the resistance element. The energy source 20 is arranged in an effective heating pattern such as a concentric coil and is secured to the base of an insulating liner 22 which is supported in a sheet metal support pan 24. The insulating liner 22 includes an annular, upwardly extending portion 26 that serves as an insulating spacer between the energy source 20 and the glass-ceramic plate 12. The support pan 24 is spring loaded upwardly, forcing the annular portion 26 into a buffing engagement with the underside of the glass-ceramic plate 12, by conventional support means (not shown).

The energy source 20 is coupled to a power source 28 (typically a standard 240 volt, 60 Hz AC power source) via suitable power lines 30. A power source control means such as a triac 32 is provided to regulate the level of power delivered to the energy source 20. The triac 32 is a conventional semiconductor device capable of conducting current in either direction across its main terminals when triggered by either a positive or negative voltage or signal 34 applied to its gate terminal 36. An electronic controller 38 supplies the gate signal 34. The controller 38 controls the power applied to the energy source 20 by controlling the rate at which gate signals 34 are applied to the triac gate terminal 36. The gate signal pulse rate is dictated under an open-loop mode by the power setting selections for the burner assembly 18 entered by user actuation of the control panel 16. Although not shown in FIG. 2, other energy sources included in the appliance 10 are connected to the power source 28 in the same manner as, and in parallel with, the illustrated energy source 20.

A temperature sensor 40 is provided to detect the temperature of the glass-ceramic plate 12. In one preferred embodiment, the temperature sensor 40 is an optical detector located so as to receive radiation from the heated portion of the glass-ceramic plate 12. As shown in FIG. 2, this is accomplished by locating the temperature sensor 40 outside of the burner assembly 18, adjacent to an opening 42 in the center of the support pan 24 and the liner 22. Alternatively, the temperature detector could be located farther away from the burner assembly 18 and a waveguide or other non-imaging optics (not shown) would be used to direct the radiation onto the temperature sensor 40. This permits the temperature sensor 40 to be located in a more favorable thermal environment and permits the co-location and sharing of temperature sensors among several burner assemblies. The optical detector could be a thermopile, bolometer, photon detector or any other device that is sensitive to infrared radiation. As an alternative to optical detectors, the temperature sensor 40 could be a device, such as a resistance temperature detector, attached directly to the underside of the glass-ceramic plate 12. In any event, the temperature sensor 40 generates a signal 44 indicative of temperature that is fed to the controller 38.

During open-loop mode operation, a user selects the desired cooking setting via manipulation of the control panel 16. The controller 38 then supplies gate signals 34 to the triac gate terminal 36 at an appropriate rate so as to provide the necessary level of power from the power source 28 to the energy source 20. However, overheating of the glass-ceramic plate 12 should be avoided to insure long life. Thus, the controller 38 monitors the temperature signal 44 provided by the temperature sensor 40 to insure that the glass-ceramic temperature does not exceed a maximum safe level. Specifically, as the utensil 15 is being heated, the temperature of the glass-ceramic plate 12 will generally increase. If the glass-ceramic temperature reaches a preset value, which is typically in the range of 600–700° C., then the controller 38 will activate its thermal limiter mode to protect the glass-ceramic plate 12 from overheating. Under the thermal limiter mode, the controller 38 controls the pulse rate of the gate signals 34 such that the power supplied to the energy source 20 is reduced to maintain the glass-ceramic temperature below the maximum safe level. Accordingly, the glass-ceramic temperature is maintained at a relatively constant level during the thermal limiter mode.

The controller 38 also provides a boil dry detection function. As mentioned previously, a boil dry condition occurs when all the liquid contents of a heated utensil are boiled off. In response to detecting a boil dry condition, the controller 38 shuts off power to the energy source 20 and optionally sends a triggering signal to an alarm 46.

Figure 3:
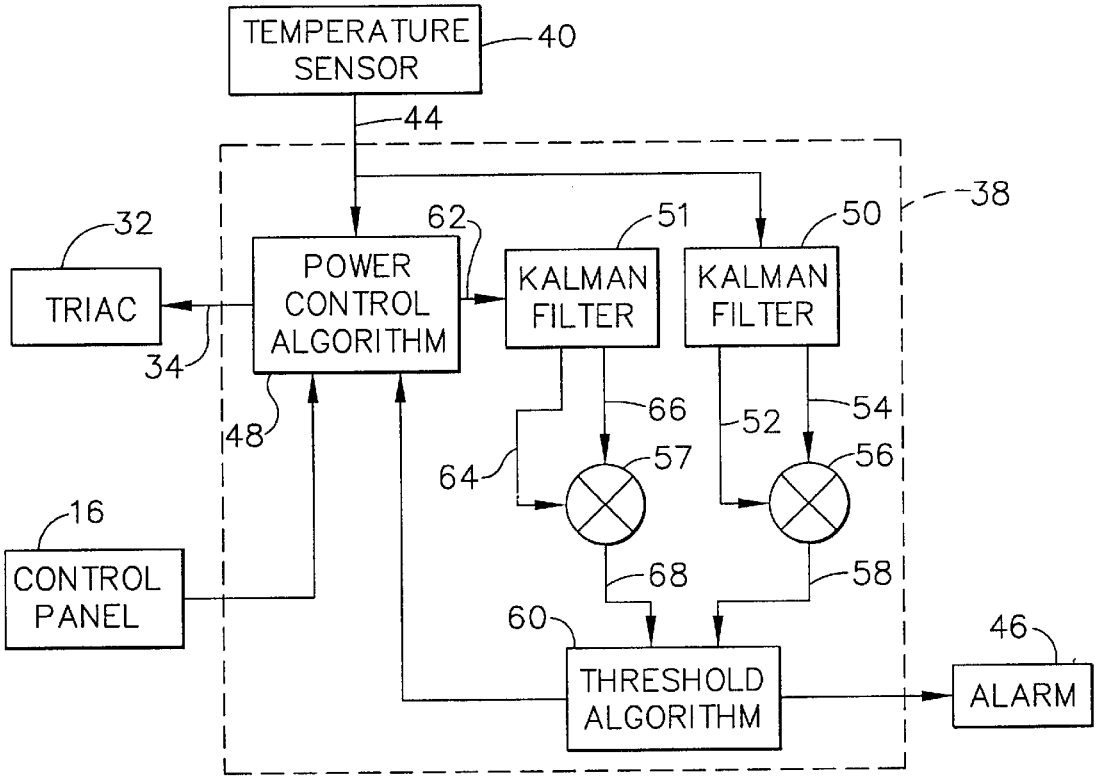
FIG. 3 is a schematic representation of a controller for the glass-ceramic cooktop appliance of FIG. 1.

Referring now to FIG. 3, the boil dry detection scheme is described. The controller 38 comprises a power control algorithm 48 that receives both the temperature signal 44 and the input from the control panel 16. The power control algorithm 48 processes this data and determines whether to operate in the open-loop or thermal limiter mode and the pulse rate at which the gate signal 34 should be fed to the triac 32. Preferably, the power control algorithm 48 utilizes state machine logic to control switching between the open-loop and thermal limiter modes.

The controller 38 further comprises first and second Kalman filters 50 and 51. The first Kalman filter 50 also receives the temperature signal 44 and, as described in more detail below, generates two signals 52 and 54 that are estimates of the first and second derivatives, respectively, with respect to time of the temperature signal 44. The derivative signals 52 and 54 are fed to a correlator 56 that produces the cross-correlation (i.e., the product) of the two derivative signals 52 and 54. A signal 58 representative of the cross-correlation is fed to a threshold algorithm 60. The threshold algorithm 60 monitors the cross-correlation signal 58 during open loop mode operation, and if the signal 58 exceeds a predetermined threshold (indicating a boil dry condition), the threshold algorithm 60 sends a signal to the power control algorithm 48 causing it to shut off power to the energy source 20. The threshold algorithm 60 also sends a triggering signal to the alarm 46.

Figure 4:
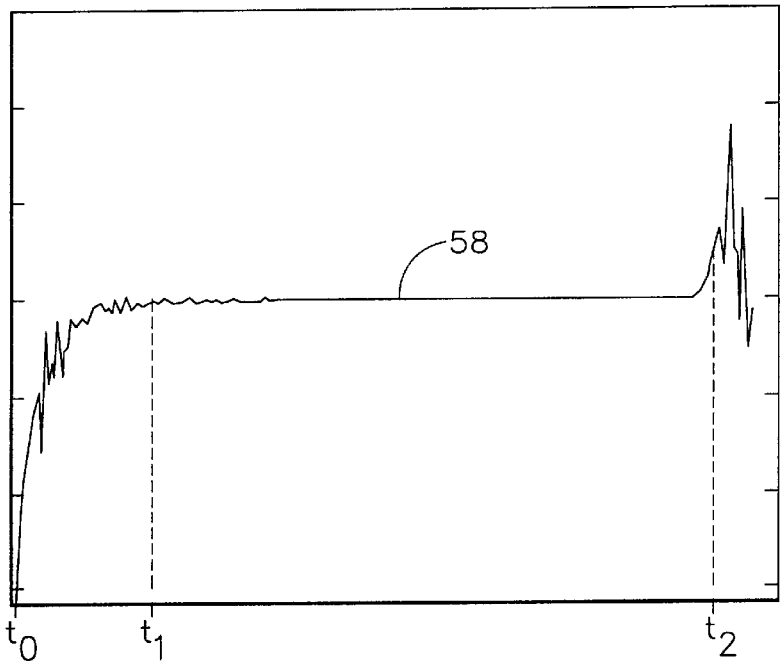
FIG. 4 is a graph plotting the cross-correlation of the first and second derivatives of the glass-ceramic temperature as a function of time.

Boil dry detection during the open-loop mode is illustrated in FIG. 4, which shows a plot of the cross-correlation signal 58 as a function of time. The utensil 15 is placed on the glass-ceramic plate 12 and the appliance 10 is turned on, at time to, causing the glass-ceramic temperature to increase from room temperature. The glass-ceramic temperature (and hence the cross-correlation signal 58) continues to rise until the utensil contents come to a boil. During the boil phase, the utensil contents will boil off at a steady temperature and remove excess heat via evaporation. With this steady heat removal, the glass-ceramic temperature and the cross-correlation signal 58 also reach a steady state value at time $t_1$, which is a short time after the contents have come to a boil. If the heating is continued, the liquid contents will eventually completely boil off, as shown at time $t_2$. At this point, there is a sudden drop in heat removal from the utensil 15, and consequently, the glass-ceramic temperature increases rapidly, causing the cross-correlation signal 58 to exceed the predetermined threshold of the threshold algorithm 60.

The cross-correlation between the first and second derivatives with respect to time of the temperature signal 44 provides a robust and effective means for detecting the rapid increase in temperature that results from a boil dry event. While the two derivatives are uncorrelated during the boiling phase, they become highly correlated (both the first and second derivatives become simultaneously large and positive) during the rapid increase in temperature when a boil dry event occurs. Thus, the cross-correlation of the first and second derivatives of the glass-ceramic temperature increases greatly during a boil dry event, providing a clear indication of the event.

In the thermal limiter mode, the power control algorithm 48 receives the temperature signal 44 and controls the pulse rate at which the gate signal 34 is fed to the triac 32 to maintain the temperature at a steady value regardless of the input from the control panel 16. Since the temperature signal 44 is maintained at a steady state, it will not spike if a boil dry condition occurs while the appliance 10 is operating under the thermal limiter mode. Thus, the controller 38 provides boil dry detection during the thermal limiter mode by monitoring the level of power applied to the energy source 20, instead of monitoring the temperature signal 44.

Accordingly, the second Kalman filter 51 receives a signal 62 from the power control algorithm 48 that is indicative of the level of power that is supplied to the energy source 20. In response to the power signal 62, the second Kalman filter 51 generates two signals 64 and 66 that are estimates of the first and second derivatives, respectively, with respect to time of the power signal 62. The derivative signals 64 and 66 are fed to another correlator 57 that produces the cross-correlation (i.e., the product) of the two derivative signals 64 and 66. A signal 68 representative of this cross-correlation is fed to the threshold algorithm 60. The threshold algorithm 60 monitors the cross-correlation signal 68 during thermal limiter mode operation, and if the signal 68 exceeds a predetermined threshold, the threshold algorithm 60 sends a signal to the power control algorithm 48 causing it to shut off power to the energy source 20. The threshold algorithm 60 can also send a triggering signal to the alarm 46. (The state machine logic of the power control algorithm 48 determines which of the two cross-correlation signals 58 and 68 is utilized depending on which mode the controller 38 is operating in.)

Figure 5:
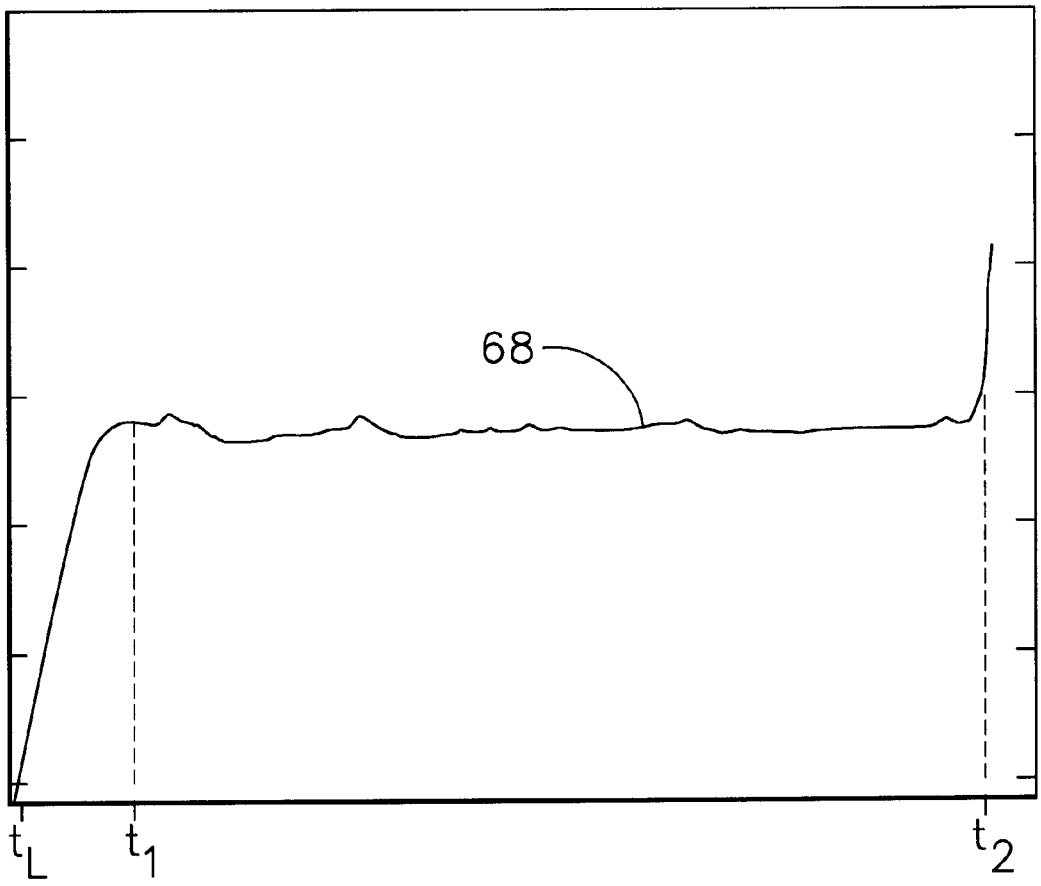
FIG. 5 is a graph plotting the cross-correlation of the first and second derivatives of the power level as a function of time.

Boil dry detection during the thermal limiter mode is illustrated in FIG. 5, which shows a plot of the cross-correlation signal 68 as a function of time. Here, time $t_0$ (not shown in FIG. 5) again represents the point at which the utensil 15 is placed on the glass-ceramic plate 12 and the appliance 10 is turned on. The power level is determined by the desired cooking setting selected by the user via manipulation of the control panel 16 and generally remains constant as long as the cooking setting is unchanged by the user. The glass-ceramic temperature will increase and at some point, represented by time $t_L$ in FIG. 5, can reach the preset value causing the power control algorithm 48 to activate the thermal limiter mode. At this point, the power control algorithm 48 will reduce the power level supplied to the energy source 20 so as to maintain the glass-ceramic plate 12 at a safe temperature. This means that the cross-correlation signal 68, which is the product of the negative first and second derivative signals 64 and 66, will increase.

At some point in the heating process (which could be either before of after the time $t_L$ when the thermal limiter mode is activated), the utensil contents come to a boil. During the boil phase, the utensil contents will boil off at a steady temperature and remove excess heat via evaporation at a steady rate. With this steady heat removal, the power level supplied to the energy source 20 in order to maintain the glass-ceramic temperature at its safe level will reach a steady state value at time $t_1$, although there may be slight fluctuations in the power level due to changes in room temperature and the like. The cross-correlation signal 68 will also remain generally steady during this phase. Continued heating will result in the liquid contents eventually being completely boiled off, as shown at time $t_2$. At this point, there is a sudden drop in heat removal from the utensil 15 meaning less power is required to maintain the glass-ceramic temperature. Therefore, the power signal 62 will show an abrupt drop, and the cross-correlation signal 68 will increase rapidly and exceed the predetermined threshold. As before, the threshold algorithm 60 sends a signal to the power control algorithm 48 causing it to shut off power to the energy source 20. The threshold algorithm 60 can also send a triggering signal to the alarm 46.

The cross-correlation between the first and second derivatives with respect to time of the power signal 62 provides a robust and effective means for detecting the rapid decrease in power that results from a boil dry event during thermal limiter mode operation. While the two derivatives are again uncorrelated in general, they become highly correlated (both the first and second derivatives become simultaneously large and negative) during the drop in power that occurs upon a boil dry event. Thus, the cross-correlation of the first and second derivatives of the power signal 62 increases greatly during a boil dry event, providing a clear indication of the event.

The Kalman filters 50 and 51 are dynamic systems designed to obtain smooth on-line estimates of first- and second-order derivatives of a signal s(t) with respect to time. The signal s(t) is the temperature signal 44 for the first Kalman filter 50 and the power signal 62 for the second Kalman filter 51. The Kalman filter design entails (i) postulating a suitable dynamic model that describes the general behavior of the signal s(t), and (ii) designing appropriate modifications to the model, based on estimates of the noise in the signal, such that the resulting modified model yields the best smooth estimates of the signal and its derivatives. For the purpose of obtaining smooth estimates of the time derivatives of the temperature signal 44 (during the open-loop mode) or the power signal 62 (during the thermal limiter mode), a triply-integrated "white" noise model is postulated as the basis for the Kalman filters 50 and 51. More specifically, the model is given by the following set of differential equations:

$$dx_1/dt=x_2$$
$$dx_2/dt=x_3$$
$$dx_3/dt=w \tag{1}$$

where the signal s(t) is given by the "state" variable $x_1$, while its first- and second-order derivatives with respect to time t are given by the state variables $x_2$ and $x_3$, respectively. That is:

$$x_1=s(t)$$
$$x_2=ds(t)/dt$$
$$x_3=d^2s(t)/dt^2$$

Note that in the above dynamic model, the third-order derivative (i.e., $d^3s(t)/dt^3=dx_3/dt=w$) is assumed to be random "white" noise w(t). Defining the state vector $x(t)=[x_1(t)\ x_2(t)\ x_3(t)]^T$, the dynamic model in equation (1) for the signal s(t) is given in the compact form:

$$dx(t)/dt=Ax(t)+Ww(t)$$
$$s(t)=Cx(t)+v(t) \tag{2}$$

where w(t) is the process noise, v(t) is the measurement noise, and:

$$A=\begin{bmatrix}0&1&0\\0&0&1\\0&0&0\end{bmatrix},\ C=\begin{bmatrix}1\\0\\0\end{bmatrix}\text{ and }W=\begin{bmatrix}0\\0\\1\end{bmatrix}$$

The above continuous time model in equation (2) can be written as an equivalent model in discrete time. More specifically, for a sampling time $T_s$, the dynamic model in equation (2) can be written in discrete time as:

$$x(k+1)/dt=A_dx(k)+W_dw(k)$$
$$s(k)=Cx(k)+v(k) \tag{3}$$

where x(k), s(k), w(k), v(k) denote the respective variables at sample k, i.e. time instant $k*T_s$, and $$W_d=\int_0^{T_s}\exp(At)W\,dt$$

For the discrete time dynamic system in equation (3), the Kalman filters 50 and 51 are designed based on appropriate estimates for the covariance of the process noise E(ww')=Q and the measurement noise E(vv')=R, using a standard Kalman filter algorithm. The resulting Kalman filters 50 and 51 have the following description:

$$x(k+1,k)=Ax(k,k-1)+L\{s(k)-Cx(k,k-1)\}$$
$$s(k,k)=Cx(k,k)$$
$$x(k,k)=x(k,k-1)+M\{s(k)-Cx(k,k-1)\} \tag{4}$$

where L and M are matrices based on the process noise estimate Q and the measurement noise estimate R and x(k,k−1) denotes the best smooth estimate of the state x at sample k, given the (noisy) measurements of the signal s up to the previous sample (i.e., s(k−1), s(k−2), . . . ), while s(k,k) and x(k,k) denote the best smooth estimates of the signal s and the states x at sample k, using the most recent (noisy) signal measurements (s(k), s(k−1), . . . ). In particular, the second and third components of the vector x(k,k) (i.e., $x(k,k)_2$ and $x(k,k)_3$) give the best smooth estimates of the desired first- and second-order time derivatives of the noisy signal s(k) at any sample k. The product of the two derivatives yields the desired cross correlation that is used to detect the sharp increase in the temperature signal 44 or the sharp decrease in the power signal 62 that occurs as the utensil 15 goes through boil-dry in open-loop or thermal limiter mode, respectively.

The above-described Kalman filter-based approach for obtaining the estimates of the derivatives, which are used subsequently for evaluating the cross correlation, is superior to other numerical derivative-based approaches. For instance, one other approach to obtaining the derivative estimates involves the combination of appropriate numerical derivative estimates (e.g., backward difference or higher order polynomial derivative approximations) with suitable low-pass filters (to attenuate the noise). However, the sequential calculation of the first- and second-order derivatives and low-pass filtering adds undesirable phase lags which results in non-smooth and/or inaccurate cross-correlation. This in turn leads to more false, late and/or missed alarms. The Kalman filter-based approach provides both (first- and second-order) derivative estimates simultaneously and is superior in yielding smoother and more accurate cross correlation, and thus, less false, late or missed alarms.

The foregoing has described a method and system for automatically detecting boil dry conditions in a cooking appliance operating in either its open-loop or thermal limiter modes. While specific embodiments of the present invention have been described, it will be apparent to those skilled in the art that various modifications thereto can be made without departing from the spirit and scope of the invention as defined in the appended claims.

What is claimed is:

1. A boil dry detection system for a cooking appliance having at least one energy source with a variable level of power supplied thereto said system comprising:

means for providing a signal representative of a parameter associated with said cooking appliance;

means for generating an estimate of the first and second derivatives of said signal with respect to time;

means for producing the cross-correlation of said first and second derivative estimates; and means for providing a boil dry indication when said cross-correlation exceeds a predetermined threshold.

2. The boil dry detection system of claim 1 wherein said means for providing a signal comprises a temperature sensor.

3. The boil dry detection system of claim 1 wherein said means for providing a signal provides a signal that is indicative of said level of power being supplied to said energy source.

4. The boil dry detection system of claim 1 wherein said means for generating an estimate of the first and second derivatives of said signal comprises a Kalman filter.

5. The boil dry detection system of claim 1 further comprising means for controlling said level of power being supplied to said energy source, wherein said means for controlling shuts off power to said energy source in response to a boil dry indication.

6. The boil dry detection system of claim 1 further comprising an alarm that is triggered in response to a boil dry indication.

7. A boil dry detection system for a cooking appliance having at least one energy source disposed under a cooking surface and a power source for providing a variable level of power to said energy source, said system comprising:

a temperature sensor providing a temperature signal representative of the temperature of said cooking surface;

means for controlling said level of power being supplied to said energy source, said means for controlling providing a power signal that is indicative of said level of power being supplied to said energy source;

means for selectively generating an estimate of the first and second derivatives with respect to time of either one of said temperature signal or said power signal;

means for producing the cross-correlation of said first and second derivative estimates; and means for providing a boil dry indication when said cross-correlation exceeds a predetermined threshold.

8. The boil dry detection system of claim 7 wherein said means for generating an estimate of the first and second derivatives of said signal comprises first and second Kalman filters.

9. The boil dry detection system of claim 7 wherein said means for controlling is responsive to said temperature signal so as to prevent said cooking surface from exceeding a maximum temperature.

10. The boil dry detection system of claim 7 wherein said means for controlling shuts off power to said energy source in response to a boil dry indication.

11. The boil dry detection system of claim 7 further comprising an alarm that is triggered in response to a boil dry indication.

12. A method of detecting a boil dry condition in a utensil being heated on a cooking appliance having at least one energy source, said method comprising the steps of:

providing a signal representative of at least one parameter associated with said cooking appliance;

generating an estimate of the first and second derivatives of said signal with respect to time;

producing the cross-correlation of said first and second derivative estimates; and providing a boil dry indication when said cross-correlation exceeds a predetermined threshold.

13. The method of claim 12 wherein said cooking appliance includes a cooking surface and said parameter is the temperature of said cooking surface.

14. The method of claim 12 wherein said parameter is the level of power being supplied to said energy source.

15. The method of claim 12 wherein said step of generating an estimate of the first and second derivatives of said signal includes Kalman filtering.

16. The method of claim 12 further comprising the step of shutting off power to said energy source in response to a boil dry indication.

17. The method of claim 12 further comprising the step of triggering an alarm in response to a boil dry indication.

* * * * *

UNITED STATES PATENT AND TRADEMARK OFFICE

CERTIFICATE OF CORRECTION

PATENT NO. : 6,384,384 B1
DATED : May 7, 2002
INVENTOR(S) : Connolly et al.

It is certified that error appears in the above-identified patent and that said Letters Patent is hereby corrected as shown below:

Column 8,
One part of the equation was omitted. The equation should read as follows:

$$A_d = \exp(A * T_s)$$

$$W_d = \int_0^{T_s} \exp(At) W dt$$

Signed and Sealed this

Seventeenth Day of December, 2002

JAMES E. ROGAN
*Director of the United States Patent and Trademark Office*